US005702742A

United States Patent [19]

Jones

[11] Patent Number: 5,702,742

[45] Date of Patent: Dec. 30, 1997

[54] CONTAINER AND LOLLIPOP COMBINATION

[75] Inventor: Wayne H. Jones, Idaho Falls, Id.

[73] Assignee: Spangler Candy Company, Bryan, Ohio

[21] Appl. No.: 778,583

[22] Filed: Jan. 3, 1997

Related U.S. Application Data

[63] Continuation of Ser. No. 478,508, Jun. 7, 1995, abandoned, which is a continuation-in-part of Ser. No. 112,016, Aug. 25, 1993, abandoned.

[51] Int. Cl.[6] ..... B65D 81/00; B65D 6/00

[52] U.S. Cl. ..... 426/115; 426/110; 426/134; 426/106

[58] Field of Search ..... 426/110, 115, 426/91, 130, 421, 90, 134, 106

[56] References Cited

U.S. PATENT DOCUMENTS

| | | | |
|---|---|---|---|
| D. 95,215 | 4/1935 | Barone et al. . | |
| D. 359,607 | 6/1995 | Yun | 426/115 |
| 1,041,315 | 10/1912 | Marx . | |
| 1,213,235 | 1/1917 | Meiers . | |
| 1,312,325 | 8/1919 | Hinck . | |
| 1,527,832 | 2/1925 | Bragg et al. . | |
| 1,646,534 | 10/1927 | Horowitz | 426/110 |
| 1,814,785 | 7/1931 | Broadwell | 426/106 |
| 1,933,596 | 11/1933 | Maclean | 426/134 |
| 1,939,450 | 12/1933 | Horton | 426/91 |
| 1,947,872 | 2/1934 | Nolte | 426/110 |
| 2,162,224 | 6/1939 | Legge | 426/115 |
| 2,166,619 | 7/1939 | Becker | 426/115 |
| 2,312,046 | 2/1943 | Neilson | 426/421 |
| 2,317,067 | 4/1943 | Knaust | 426/110 |
| 2,424,098 | 7/1947 | Kaskouras . | |
| 2,655,968 | 10/1953 | Simmons . | |
| 2,682,234 | 6/1954 | Baldanza . | |
| 2,687,157 | 8/1954 | Cowan . | |
| 2,735,778 | 2/1956 | Taylor | 426/110 |
| 2,910,172 | 10/1959 | Peaslee . | |
| 2,950,946 | 8/1960 | Starworth . | |
| 2,980,039 | 4/1961 | Jolly | 426/134 |
| 3,043,354 | 7/1962 | Fitzgerald . | |
| 3,088,643 | 5/1963 | Dunn | 426/134 |
| 3,122,441 | 2/1964 | Smith . | |
| 3,127,985 | 4/1964 | Scott . | |
| 3,325,847 | 6/1967 | Meranto . | |
| 3,432,027 | 3/1969 | Mueller | 426/115 |
| 3,821,425 | 6/1974 | Russell | 426/134 |
| 4,244,470 | 1/1981 | Burnham | 426/115 |
| 4,732,273 | 3/1988 | De Marc . | |
| 4,753,366 | 6/1988 | Ritter . | |
| 4,765,501 | 8/1988 | Kao | 426/104 |
| 4,902,519 | 2/1990 | Ream et al. | 426/134 |
| 4,930,638 | 6/1990 | Vasconcello . | |
| 4,974,738 | 12/1990 | Kidd . | |
| 5,133,980 | 7/1992 | Ream et al. . | |
| 5,248,081 | 9/1993 | Hook . | |
| 5,370,884 | 12/1994 | Coleman | 426/134 |
| 5,458,277 | 10/1995 | Wyzykowski | 224/202 |
| 5,503,857 | 4/1996 | Coleman et al. | 426/134 |

FOREIGN PATENT DOCUMENTS

| | | | |
|---|---|---|---|
| 1071008 | 3/1950 | France . | |
| 2469362 | 2/1981 | France | 426/110 |
| 610746 | 5/1979 | Switzerland | 426/134 |
| 2084846 | 4/1982 | United Kingdom | 426/134 |
| 2093433 | 9/1982 | United Kingdom | 426/134 |
| WO93/00267 | 1/1993 | WIPO | 426/104 |

OTHER PUBLICATIONS

Packaging Mar., 1994 p. 66.

Topps Co. Flyer "Push Pop" Dec., 1993.

The Ulitmate Jaw Breaker product, available through Confection Creative Concepts, Inc., Fox Point, Wisconsin 53217 No Date.

*Primary Examiner*—Steven Weinstein
*Attorney, Agent, or Firm*—Michael A. O'Neil; Russell N. Rippamonti

[57] ABSTRACT

An egg-shaped container for containing an egg-shaped lollipop immediately after manufacture, during inventory storage, at point of sale and after partial consumption, both when stored separate from and when carried by the user, is disclosed herein.

1 Claim, 4 Drawing Sheets

CONTAINER AND LOLLIPOP COMBINATION

RELATED APPLICATION

This application is a file wrapper continuation of application Ser. No. 08/478,508 filed on Jun. 7, 1995, now abandoned, which file is a continuation-in-part of application Ser. No. 08/112,016, filed on Aug. 25, 1993, now abandoned.

FIELD OF INVENTION

The present invention relates generally to confectionery containers and more particularly to novel containers for new and used lollipops and related method.

BACKGROUND

The containment of suckers or lollipops at the time of manufacture, during storage prior to sale after being manufactured, and after partial consumption has presented persistent problems in the past.

For example, when a paper or plastic film covering has been used, separation of the two at the time of use has frequently resulted in only partial removal of the covering. Sometimes, the stickiness of the lollipop is transferred to the fingers and hands of the user during removal of the covering.

Failure to provide a suitable container, using prior techniques, including coverings, has contributed to a short-term storage life following manufacture and prior to sale.

Users, especially small children, often desire to only partially consume a lollipop at any one point in time, hoping to save the remainder for one or more later points in time. However, the container or covering used during the on-sale stage of the lollipop is usually discarded, but when it has been saved, or a new covering is provided, the wetted nature of the partially consumed product make subsequent separation difficult and messy. Often, the partially consumed lollipop is left on a table, a furniture piece, a chair, or a floor, only to be cleaned up and discarded by a frustrated parent.

Sometimes, the user wished to carry the partially consumed lollipop with him or her for later readily available use. The original or another covering is typically used and a pocket or purse is sometimes the temporary storage site. This tends to fuse the covering and the wetted partially consumed lollipop, making all the more difficult subsequent separation of the two. The pocket or purse may become soiled and sticky as a consequence of direct exposure of the lollipop thereto due to, for example, weeping, pressure, heat, and partial uncovering of the stored lollipop.

There has long existed a need for a more satisfactory way of containing lollipops immediately after manufacture, during storage prior to sale, and after partial consumption, both when stored separate from or carried by the user.

BRIEF SUMMARY AND OBJECTS OF THE INVENTION

In brief summary, the present invention resolves or substantially alleviates the aforementioned problems and provides a simple, satisfactory, and efficient way of containing lollipops immediately after manufacture, during storage prior to sale, and after partial consumption, both when stored separate from or carried by the user.

With the foregoing in mind, it is a primary object of the present invention to overcome or substantially alleviate the aforementioned problems.

A further paramount object is the provision of a more satisfactory way of containing lollipops immediately after manufacture, during storage prior to sale, and after partial consumption, both when stored separate from or carried by the user.

It is a further dominant object of the present invention to provide novel containers for new and used lollipops and related methods.

It is another significant object of the present invention to provide containment for suckers or lollipops at the time of manufacture.

It is an additional significant object to provide for containment of suckers or lollipops in a satisfactory, isolated fashion during storage after manufacture and prior to sale.

Another object of importance is the provision of containment for suckers or lollipops after partial consumption, either separate from or on the person of the user.

A further predominant object of the present invention is the provision of containment for lollipops after partial consumption which allows for both ready access to the lollipop at any time desired by the user for non-messy storage of the partially consumed lollipop, either separate from or on the person of the user.

A further valuable object is the provision of a dual sucker-single stem lollipop and to satisfactorily contain the same when manufactured, during storage prior and after sale and after partial use.

These and other objects and features of the present invention will be apparent from the detailed description taken with reference to the accompanying drawings.

DETAILED DESCRIPTION OF THE ILLUSTRATED EMBODIMENTS

Figure 1:
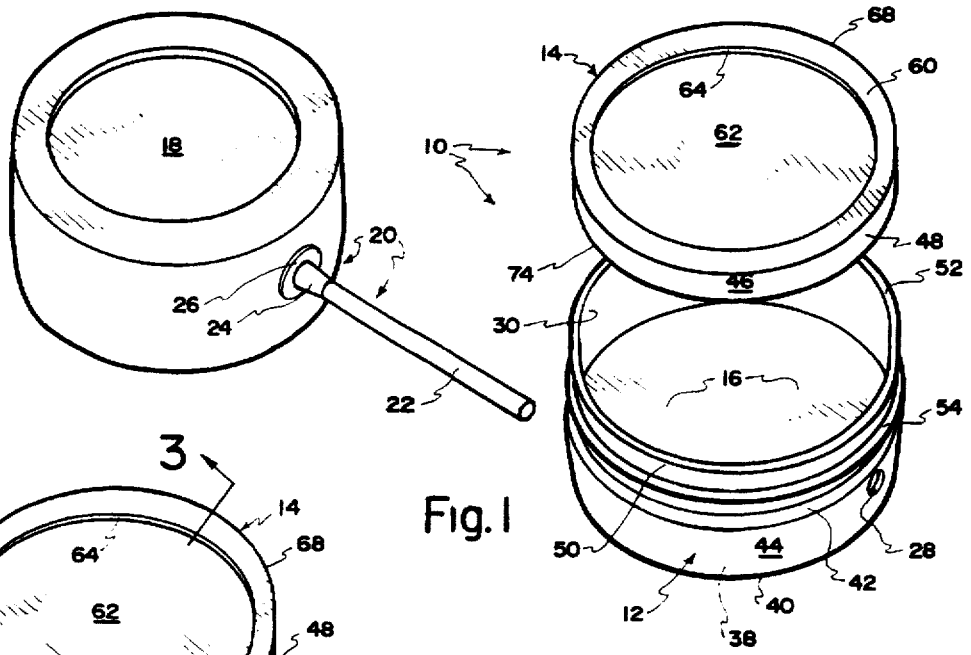
FIG. 1 is an exploded perspective of one embodiment of the present invention comprising a container in which a lollipop or sucker may be placed for a point of sale distribution and/or initial storage and/or interim storage after partial use.
Figure 2:
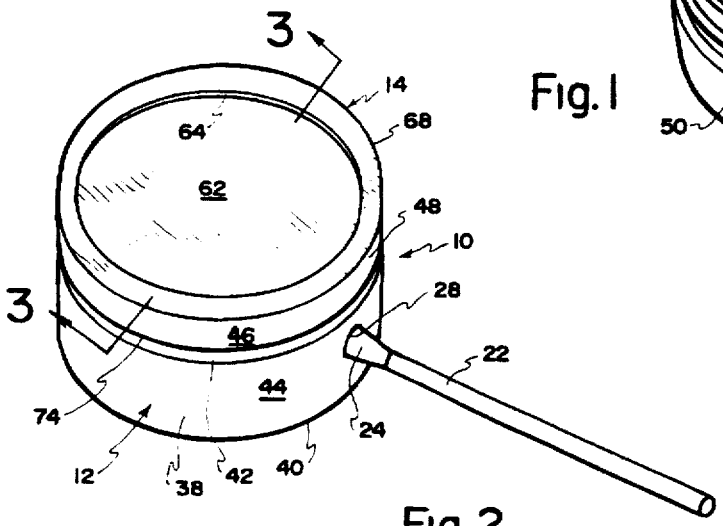
FIG. 2 is a perspective representation of the lollipop container with the lollipop disposed therein, shown in the assembled condition.
Figure 3:
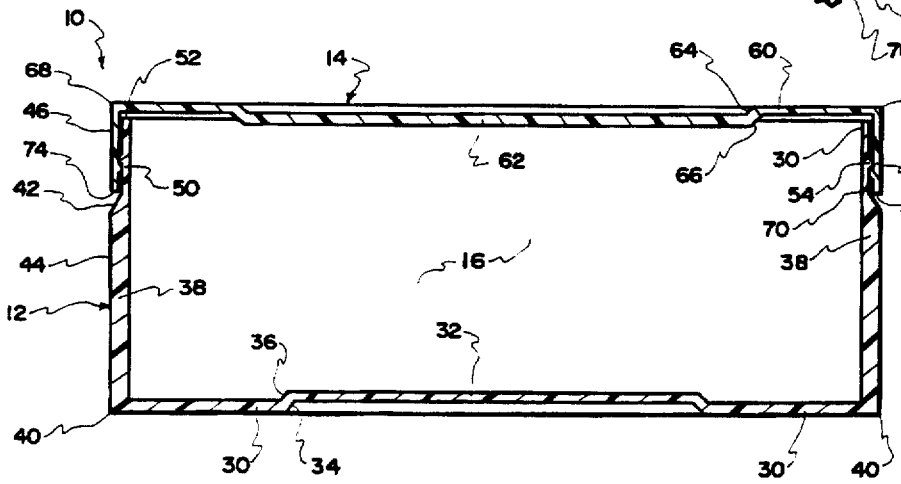
FIG. 3 is cross-section taken along lines 3—3 of FIG. 2.

Reference is now made to the drawings wherein like numerals are used to designate like parts throughout. A first container or receptacle, generally designated 10, is illustrated in FIGS. 1–3, to which reference is now made. The container 10 comprises a hollow body, generally designated 12, and a snap-fit removable lid, generally designated 14. The container body 12 and closure of lid 14 or illustrated as being formed of a suitable synthetic resinous material, such as polyethylene, using conventional techniques of injection molding. However, other types of manufacture may be used, including but not limited to thermo-molding and vacuum forming. Accordingly, both the container body 12 and the closure of lid 14 retain their shape and configuration.

The container body 12 comprises a hollow interior 16, sized and shaped to receive a consumable portion 18 of a lollipop or sucker, generally designated 20. The consumable portion 18 of the lollipop 20 is integrally connected to a substantially rigid or stiff shaft, rod, or stem 22 of conventional construction. The stem 22 extends internally into and supports the consumable portion 18 of the lollipop 20 through a fitting 24 comprising a transverse flange 26.

With the container lid 14 removed, the lollipop 20, both immediately following manufacture and after partial consumption of the consumable portion 18 is placed in the container body 12 by displacing the stem 22 through a small side opening 28 until the consumable portion 18 is substantially aligned with the hollow 16 of the container body 12 and the fitting 24 substantially fills the opening 28, at which time the consumable portion 18 is positioned entirely within the hollow 16. The closure of lid 14 is then force-fit over the access opening 30 of the container body 12 to close the access opening 30 with the edible portion 18 of the lollipop 20 being isolated in the hollow interior 16, as illustrated in FIG. 2. The specifics of the container body 12 and lid 14 are best shown in FIG. 3, where the lollipop 20 has been removed for clarity of illustration the container body 12 comprises a generally disc-shaped base wall or floor 30, which is stiffened by a central indented wall portion 32, thus forming exterior and interior diagonal shoulders 34 and 36, respectively.

The container body 12 also comprises an upright annular wall 38 merges in which the small opening or aperture 28 is formed. Annular wall 38 merges and is integral with the bottom wall 30 at the annular corner 40. The hollow interior 16 is disposed above the bottom wall 30 and within the annular wall 38.

The thickness of the annular side wall 38 of the container body 12 is uniform below but reduced at diagonal shoulder 42 to accommodate a flush relationship between the lower exterior surface 44 of the annular wall 38 and an exterior surface 46 of a downwardly directed flange 48 of the lid 14. The reduction in thickness of the top portion 50 of the wall 38 also makes wall portion 50 more pliant to accommodate the flexing as necessary to receive the lid 14 in a snap-fit relationship, as explained hereinafter in greater detail. The upper, reduced-thickness, annular portion 50 terminates in an upper blunt annular edge 52. Upper annular wall portion 50 comprises an outwardly directed, annular radial rib 54, located approximately at the center of the vertical length of the wall portion 50. See FIG. 4.

The closure of lid 14 comprises a top peripheral wall portion 60, comprising a central depressed portion 62 which stiffens the lid. External and internal diagonal shoulders 64 and 66 connect the wall portion 62 with the peripheral portion of lid wall 60. Lid wall 60 joins downwardly directed, annular flange 48 along an integral annular corner 68. The interior surface 70 of the annular lid flange 48 comprises an inwardly directed annular bead or radial rib 72, which is illustrated as being dimensionally substantially the same as bead or rib 54.

Figure 4:
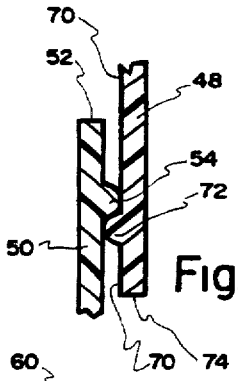
FIG. 4 is an enlarged fragmentary cross-section showing the interlocking relationship between the top container lid and the container base.
Figure 5:
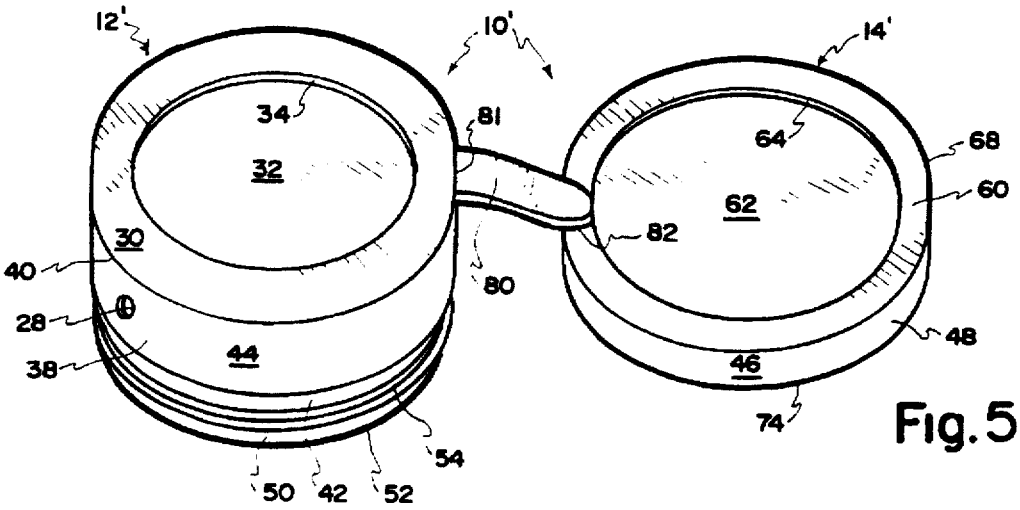
FIG. 5 is a perspective representation of a second embodiment of the present invention comprising a container, with tethered top lid, for receiving a lollipop.
Figure 6:
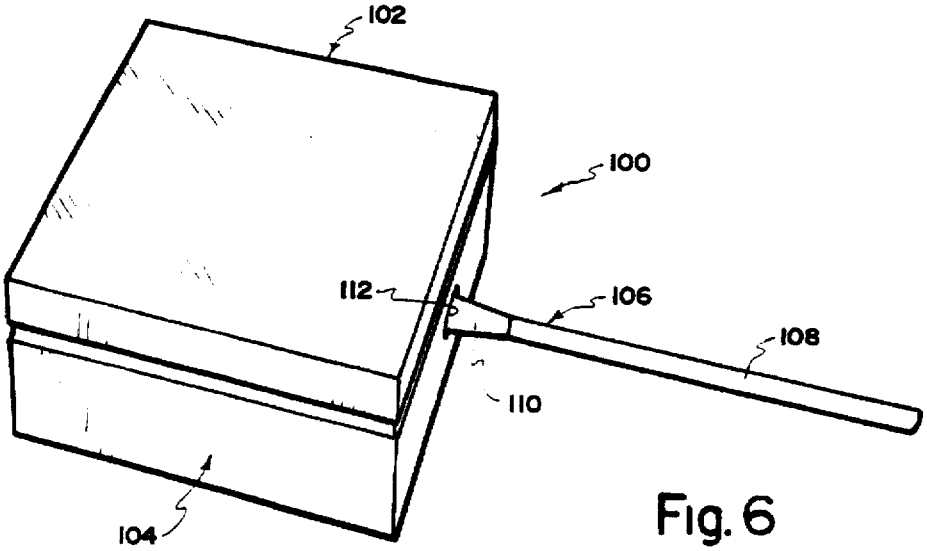
FIG. 6 is a perspective of a third embodiment of the present invention comprising a rectangularly-shaped lollipop container with a top lid and a lollipop disposed therein, shown in an assembled condition.

The thickness of flange 48 is selected to allow yieldability whereby manual pressure upon the lid 14 adjacent the corner 68 in a direction toward the container body 12 will cause the bead or rib 72 to ride over or be press-fit across the bead 54 to removably secure the lid 14 in closed position, as illustrated in FIG. 4. Nevertheless, by manually prying upon the blunt edge 74, the bead 72 can be forced back across the bead 54 to remove the lid 14 from the body container 12 to accommodate insertion and removal of the sucker 20 into and from the hollow interior 16 of the container body 12. FIG. 5 illustrates a second receptacle for new and used lollipops, generally designated 10'. Container 10' is identical, and illustrated, in all respects to previously described lollipop container 01, except one. Accordingly, those features which are common to container 10 need not again be described. The only difference between container 10 and container 10' is the existence of a plastic tether 80, illustrated as being injection molded as part of the container body 12' so as to be integral with bottom wall 20 at corner 40. The tether 80 is suitably secured to the lid wall 60 at site 82, using any suitable adhesive, bonding agent, or plastic welding technique. The tether 80 is sized so as to have sufficient strength to avoid breakage during normal use and comprises a length sufficient to allow the lid 14' to be rotated 180° from the position illustrated in FIG. 5 so as to be aligned with and be closed over the previously mentioned access opening 30, to accommodate placement and removal of the lid 14' as described above.

It is to be appreciated that the principles of the present invention embrace shapes other than the cylindrical configurations illustrated in FIGS. 1–5 and described above. Any suitable shape may be utilized. For example, a box-shaped container, generally designated 100, and illustrated in FIG. 5 may be utilized, which, other than its shape, is constructed so as to have substantially the same features as described above in conjunction with containers 10 and 10'. Container 100 comprises a transversely removable lid 102 and a container body 104 wherein rectangularly-shaped walls replace the annular and disc-shaped walls described above. A consumable portion of a lollipop 106 is placed within the hollow interior of the container body 104 in the manner described above so that a stem 108 and a stem fitting 110 thereof extend through a wall aperture 112 in one side wall of the body container 104.

Figure 7:
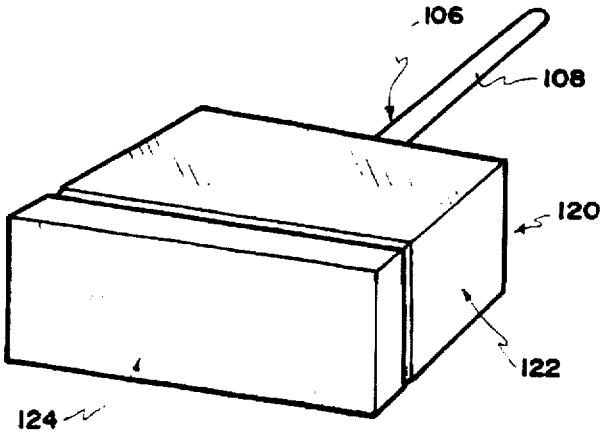
FIG. 7 is a perspective of a further embodiment of the present invention comprising a rectangularly-shaped lollipop container with an end closure and a lollipop disposed therein, shown in an assembled condition.

Similarly, with reference to FIG. 7, sucker 106 may be placed within sucker container 120, which is also box-shaped comprising a hollow, rectangularly-shaped container body, generally designated 122 and an axially located rectangularly-shaped closure or lid, generally designed 124.

It is preferred that lids 102 and 124 be snap fit upon their respective container bodies 104 and 122, as described above, or otherwise made capable of temporarily though removably closing an access opening to the container bodies 104 and 122, respectively.

Figure 8:
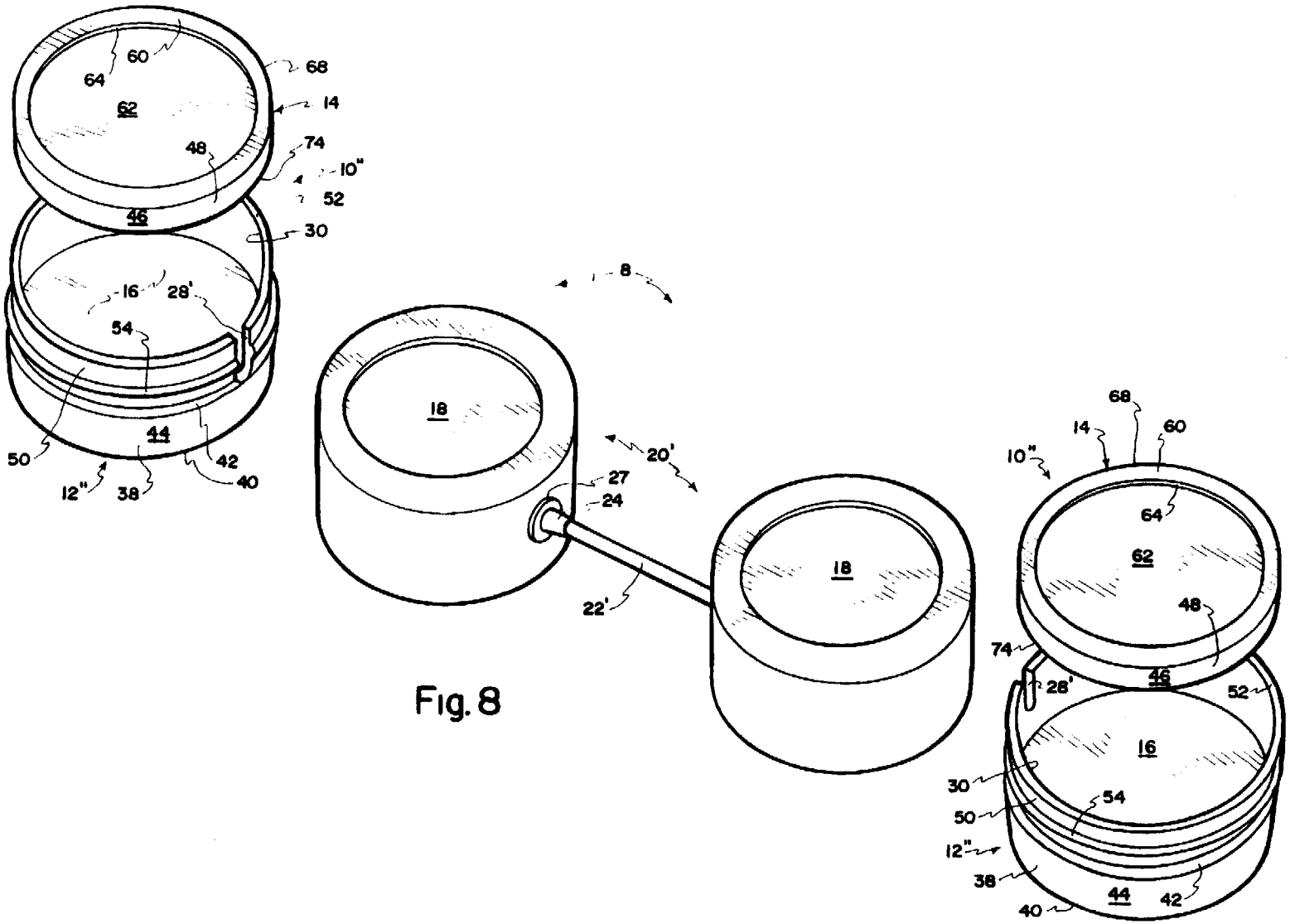
FIG. 8 is an exploded perspective of an additional dual sucker embodiment of the present invention wherein a sucker is adapted to be encased within a lollipop container.

Reference is now made to FIG. 8 which illustrates a dual lollipop embodiment in accordance with the principles of the present invention, generally designated 8. The dual lollipop configuration of the present invention, generally designated 8, comprises two lollipops 18 interconnected by single stem 22', which is substantially embedded centrally within the body of the material comprising each sucker 18. The dual sucker configuration is generally designated 20'. Stem 22' is equipped with a pair of the previously described fittings 24, comprising flange 27, only one of which is illustrated in FIG. 8. The dual lollipop configuration generally designated 8 in FIG. 8, comprises two lollipop containers, each generally designated 10". Each container 10" comprises a lid 14. Since lid 14 was previously described, no further description is needed.

Each container 10" comprises a hollow body, generally designated 12", which is identical in all respects, except one, to the previously described hollow container body 12. Accordingly, only the difference will be described here. In lieu of small opening or aperture 28, each container body 12" comprises a notch 28', illustrated as having a very narrow peripheral dimension and as being rounded at the lower edge thereof. Notches or grooves 28' accommodate direct transverse insertion of one lollipop 18 into each container body 12", without any requirement for longitudinal displacement. Thereafter the associated lid 14 may be snap-fit into place.

In use, the user can grasp one closed lollipop container 10", while exposing the opposite lollipop 18 for complete or partial consumption.

The two lollipop containers 10" provide adequate isolated storage for the dual lollipop configuration at 20' following manufacture, during storage prior to and after sale and following partial consumption of one of the lollipops 18 as well as partial consumption of the second lollipop 18 after complete consumption of the first lollipop 18.

It is to be appreciated that the U-shaped slot 28' or any other suitable slot may be used in lieu of aperture 28 in a single lollipop/single lollipop container configuration of the type described earlier.

Figure 9:
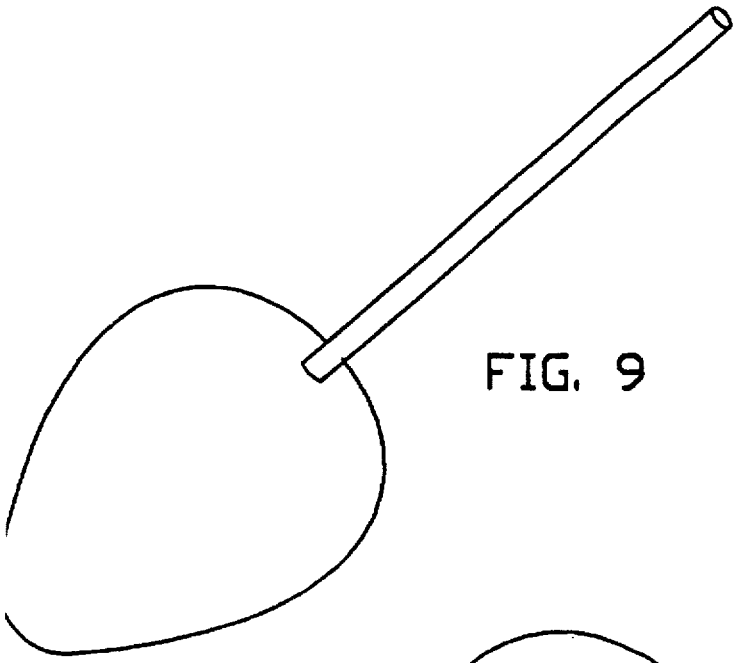
FIG. 9 is a perspective of an egg-shaped lollipop.

Reference is now made to FIG. 9, wherein an egg-shaped lollipop 100 is illustrated. The lollipop comprises an egg-shaped confectionery 120 disposed on an handle 130 having an non edible stick 131 with a distal end 132 for grasping and a proximal end 134 embedded in the egg-shaped confectionery 120. The handle 130 further includes a radial closure disk 136 located axially on the stick 131 intermediate between the proximal and distal ends and adjacent to the confectionery 120.

Figure 10:
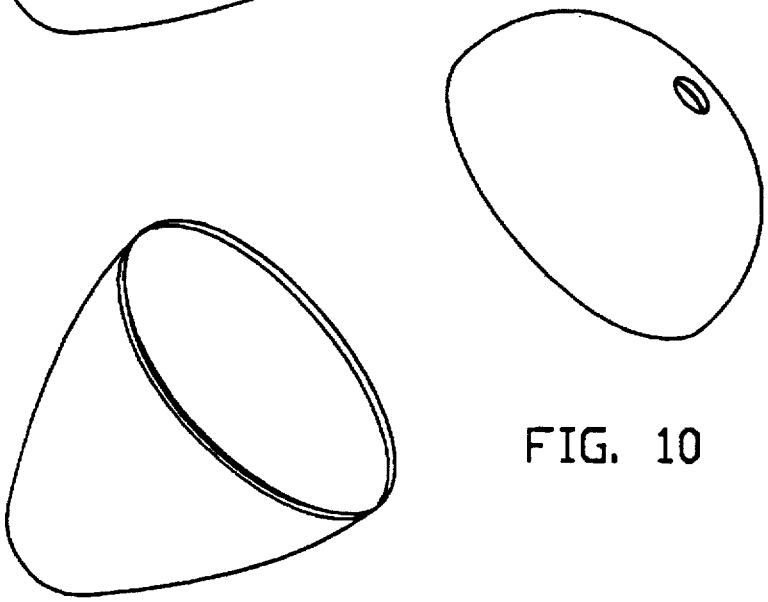
FIG. 10 is a perspective of a hollow egg-shaped container for receiving the egg-shaped lollipop of FIG. 9.

Referring to FIG. 10 wherein is disclosed a hollow egg-shaped container having a snap fit first portion 150 functioning as a partial receptacle and closure cap and mating second portion 152 functioning as a receptacle for the egg-shaped confectionery 120 (not shown). The container is sized to receive the initial, pre-consumption egg-shaped confectionery and conform substantially to the shape of the confectionery. The second portion 152 includes an opening 154 located in the rounded bottom of the egg-shape for receiving the stick 132. The opening 154 is sized larger than the cross-section of the stick 132 but smaller than the diameter of the closure disk 136.

Figure 11:
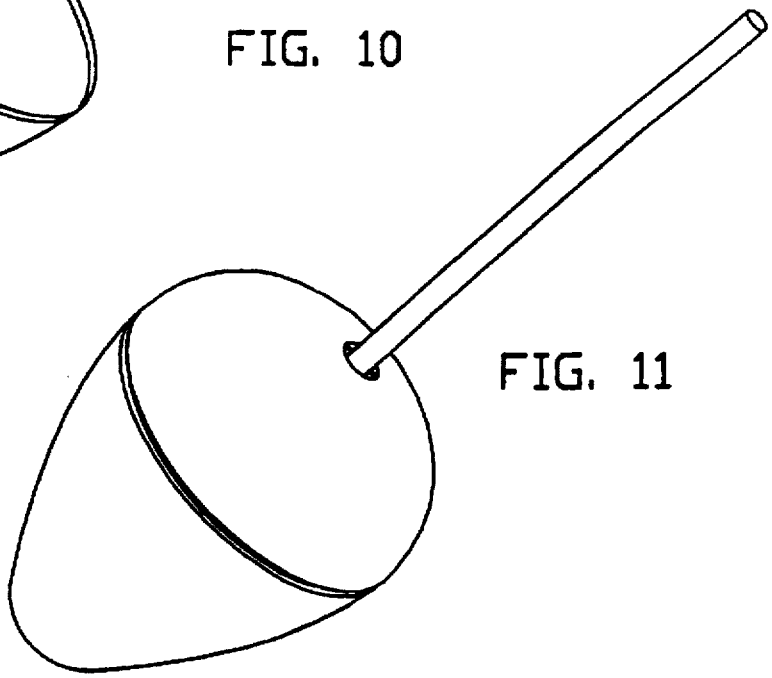
FIG. 11 is a perspective of the hollow egg-shaped container of FIG. 10 enclosing the egg-shaped lollipop of FIG. 9.

Turning now to FIG. 11, stick 131 is inserted through opening 154 until closure disk 136 seats against the rounded bottom of the egg-shaped container 152, thereby covering and sealing opening 154. First portion 150 of the hollow container is mated to second portion 152 and held closed by conventional snap fit methods thereby preventing leakage of fluid confectionery from opening 154.

The invention may be embodied in other specific forms without departing from the spirit or essential characteristics thereof. The present embodiments are, therefore, to be considered in all respects as illustrative and not restrictive, the scope of the invention being indicated by the appended Claims rather than by the foregoing description, and all changes which come within the meaning and range of equivalency of the Claims are therefore intended to be embraced therein.

I claim:

1. An egg-shaped container and lollipop combination comprising:

a. a confectionery formed in the shape of an egg;

b. a handle comprising:

a non-edible stick with a longitudinal axis, a distal end for grasping by the user, a proximal end buried in the confectionery to support the confectionery on said stick, and a radial holed closure disk having a predetermined diameter and fixably located on the handle at an intermediate point between the proximal and distal ends of the stick adjacent the confectionery and having the longitudinal axis of the stick passing through the center of the disk; and c. a hollow egg-shaped container for receiving the egg-shaped confectionery and dimensioned internally to conform substantially with and completely enclose the external dimensions of said egg-shaped confectionery; said container comprising:

a downwardly extending first portion functioning as a closure cap and dimensioned and shaped to enclose the upper portion of said confectionery and, an upwardly extending removable mating second portion functioning as a removable receptacle and dimensioned and shaped to enclose the remaining lower portion of said confectionery, said first and second container portions being reclosably mating, said second container portion further having an opening located in the bottom thereof for receiving the distal end of the stick, and said opening in said second container portion being dimensioned larger than a cross section of the stick such that said distal end of said confectionery supporting stick can be inserted into said second container portion and can be passed through said opening such that the distal end of the stick remains outside the egg shaped container and the confectionery will be completely in said container when said first container portion is releasably mated to said second container portion over said confectionery; said opening in said second container portion being smaller than the predetermined diameter of the radial closure disk such that the disk covers completely the opening when it is seated against the opening to prevent any leakage therethrough.

* * * * *